US005615900A

United States Patent [19]

Gaportsin

[11] Patent Number: 5,615,900

[45] Date of Patent: Apr. 1, 1997

[54] TOY

[76] Inventor: Iosif Gaportsin, 820 E. 10 St. Apt. 4J, Brooklyn, N.Y. 11230

[21] Appl. No.: 425,195

[22] Filed: Apr. 17, 1995

[51] Int. Cl.[6] ..... A47D 1/08

[52] U.S. Cl. ..... 280/1.22; 280/1.188; 280/30; 446/291

[58] Field of Search ..... 280/824, 1.13, 280/1.22, 1.23, 47.131, 47.16, 47.17, 47.19, 47.25, 47.34, 47.35, 30, 43.15, 47.38, 1.188, 1.189, 1.204; 446/289, 290, 291, 325

[56] References Cited

U.S. PATENT DOCUMENTS

| | | | |
|---|---|---|---|
| 1,213,017 | 1/1917 | Reinert | 280/1.13 |
| 1,345,322 | 6/1920 | Foans | 280/30 |
| 1,356,034 | 10/1920 | Black | 280/47.25 |
| 1,404,834 | 1/1922 | Chapdelaine | 280/1.23 |
| 2,605,814 | 8/1952 | Gearing | 280/47.25 |
| 2,944,814 | 7/1960 | Thoeming | 280/1.22 |
| 4,722,537 | 2/1988 | Chau-Pin | 280/1.22 |

FOREIGN PATENT DOCUMENTS

| | | | |
|---|---|---|---|
| 243677 | 3/1960 | Australia | 280/1.188 |

*Primary Examiner*—Richard M. Camby
*Assistant Examiner*—Frank Vanaman

[57] ABSTRACT

A toy has a body part formed by two animal body elements spaced from one another in a transverse direction, each of the body elements having two legs extending downwardly in a standing position of the toy and a curved back extending upwardly in the standing position of the toy, each of the body elements also having a nose portion projecting horizontally forwardly in the standing position of the toy, and connecting elements for the body elements with one another and including a first Z-shaped connecting element having two horizontal portions which are offset relative to one another in a horizontal direction and in a vertical direction and a vertical portion connecting the horizontal portion with one another and also including a second connecting element having at least one horizontal portion, so that in the standing position of the toy a user can sit on one horizontal portion and place his legs on another horizontal portion of the first connecting element, while in a position when the toy is turned upside down a user can sit on the horizontal portion of the second connecting element and rock on the curved portion of the body elements, and in a further position when the toy is turned 90° and can stand on the nose portion, the user can sit on the vertical portion of the first connecting element.

7 Claims, 5 Drawing Sheets

TOY

BACKGROUND OF THE INVENTION

The present invention relates generally to toys.

More particularly, it relates to toys which include animal figures to be used by a child to play with. Such toys can be used in different positions. It is believed to be advisable to further modify these toys so that a child can play with the toys in more positions, have more entertainment, and more useful exercises with the toy.

SUMMARY OF THE INVENTION

In keeping with these objects and with others which will become apparent hereinafter, one feature of the present invention resides, briefly stated, in a toy which has a body part formed by two animal body elements spaced from one another in a transverse direction, each of the body elements having two legs extending downwardly in a standing position of the toy and a curved back extending upwardly in the standing position of the toy, each of the body elements also having a nose portion projecting horizontally forwardly in the standing position of the toy, and means for connecting the body elements with one another and including a first Z-shaped connecting element having two horizontal portions which are offset relative to one another in a horizontal direction and in a vertical direction and a vertical portion connecting the horizontal portions with one another and also including a second connecting element having at least one horizontal portion, so that in the standing position of the toy a user can sit on one horizontal portion and place his legs on another horizontal portion of the first connecting element, while in a position when the toy is turned upside down a user can sit on the horizontal portion of the second connecting element and rock on the curved portion of the body elements, and in a further position when the toy is turned 90° and can stand on the nose portion, the user can sit on the vertical portion of the first connecting element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
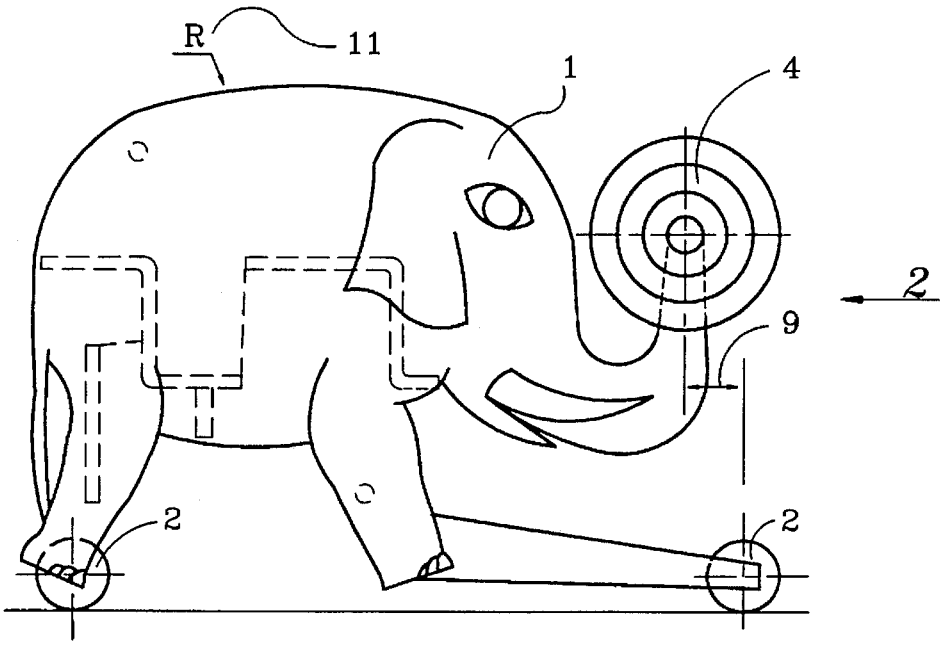
FIG. 1 is a side view showing a toy in accordance with the present invention in a standing position.
Figure 2:
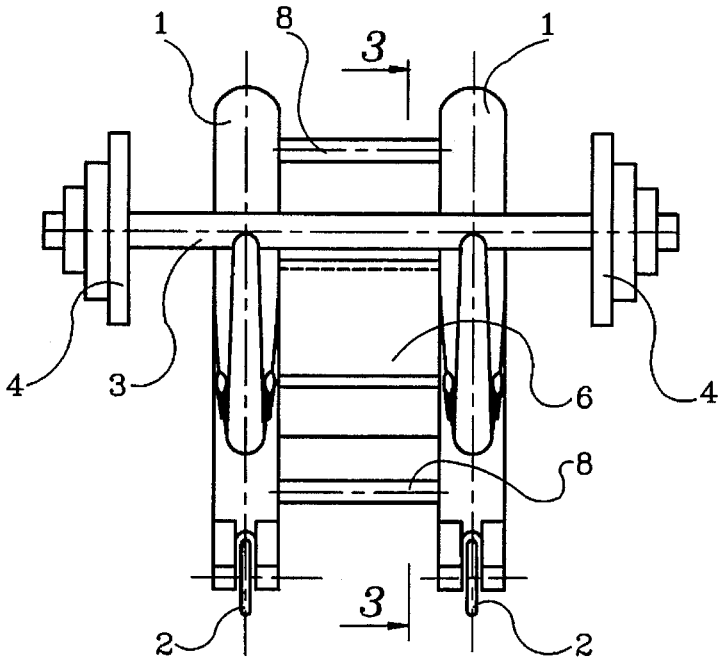
FIG. 2 is a plan view of the inventive toy.
Figure 3:
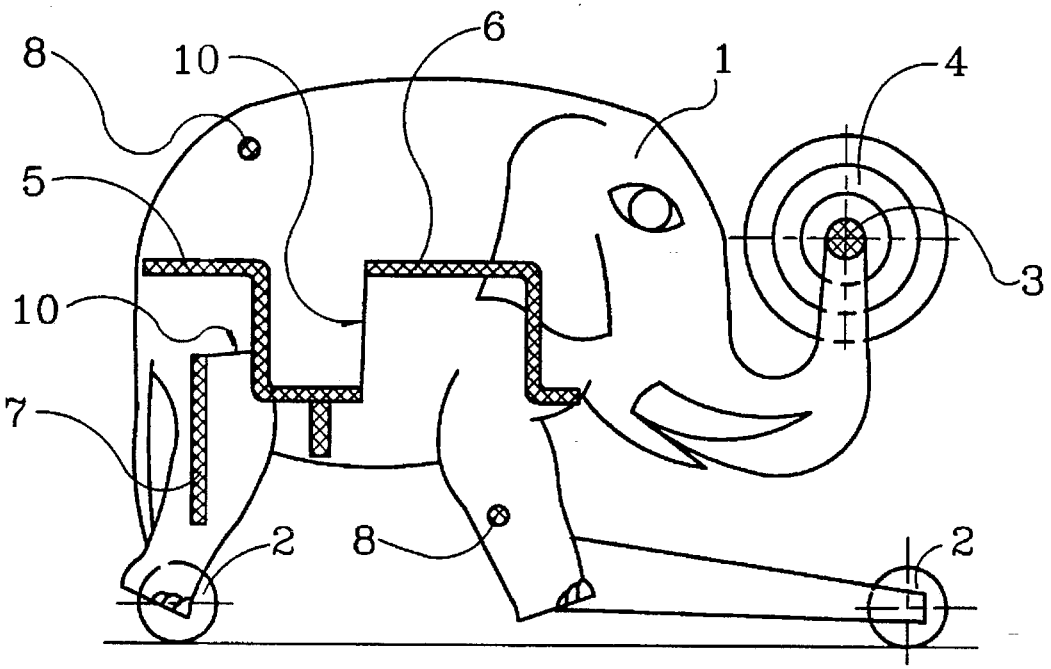
FIG. 3 is a view showing the toy of FIG. 1 in a section.

A toy in accordance with the present invention has two body elements each formed as flattened substantially three-dimensional elephant 1. The body elements are spaced from one another in a transverse direction. The toy is provided with four wheels 1. A rod 3 connects the body elements with one another and removably carriers several discs 46 having different weights. Two Z-shaped connecting elements 5, connect the body elements 1 with one another. Each Z-shaped connecting element has two horizontal portions which are offset from one another in a vertical direction and in a horizontal direction in a standing position of the toy of FIG. 1, and a vertical portion connecting the horizontal portions with one another. The portions are substantially flat. Two further flat portions 7 also connect the body elements with one another, as well as two rods 8. Reference numeral 9 identifies an eccentricity between the center of the rod 8 which connects the frontmost end of the nose portion of the body elements with one another, and a center of the front wheels 2 of the toy. Two removable belts are identified with reference numeral 10. The back of the animal has a radius of curvature identified with reference numeral 11. As can be seen from the drawings the body elements 1 imitate the figures of the elephant with a body, two legs, a head with a trunk, and a tail. The toy can be composed for example of plastic so that all elements are made of one-piece with one another. Of course, it also can be composed of a different material and not necessarily as a one-piece element, since it is possible to assemble it from different parts and then connect the parts with one another by known methods, such as by welding, screwing, etc.

Figure 4:
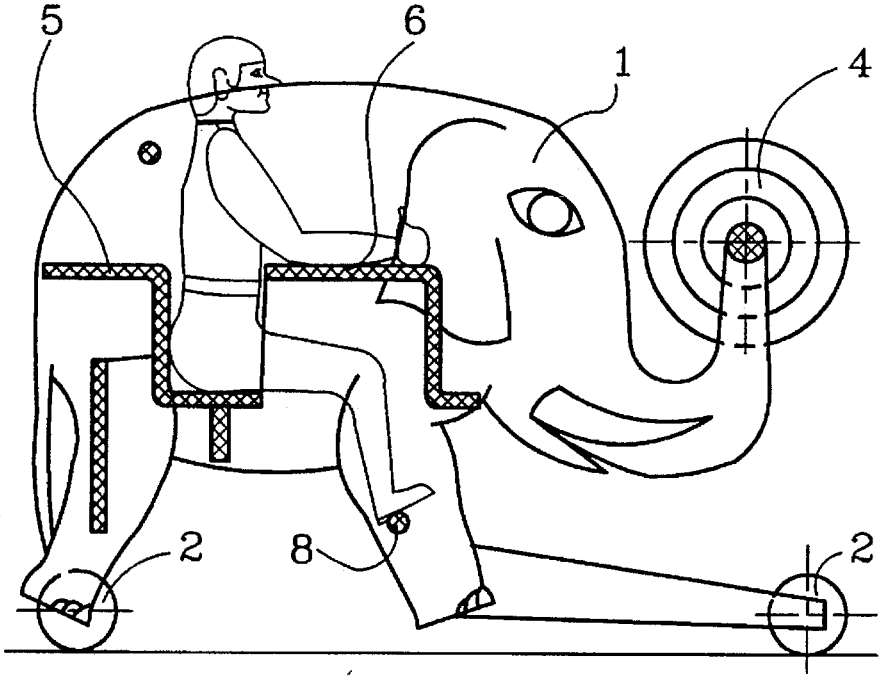
FIG. 4 is a view corresponding to the view of FIG. 3 but with a user sitting in the toy.
Figure 5:
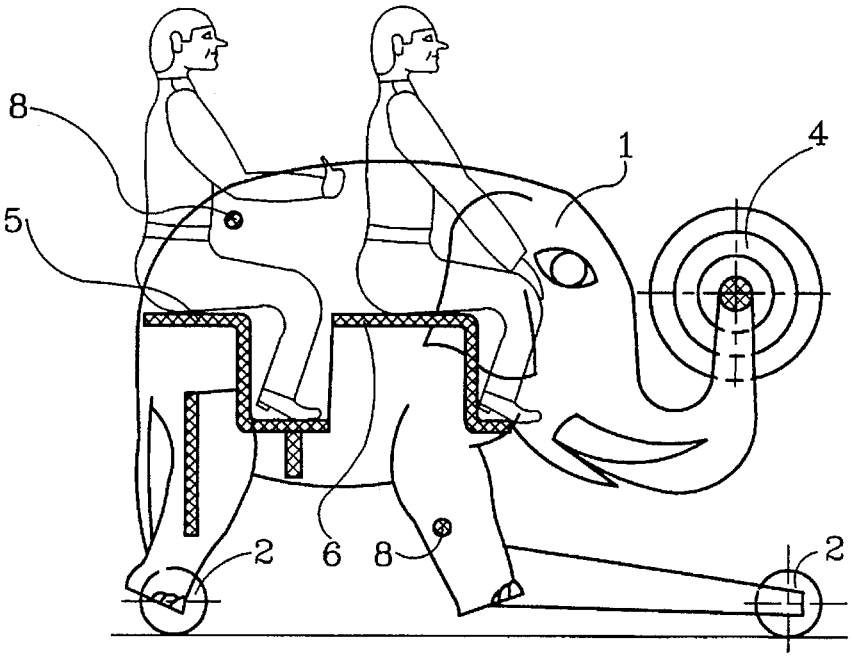
FIG. 5 is a view showing the toy of FIG. 3 with two users sitting in the toy.

As can be seen from FIG. 4, a child can sit on the lower horizontal portion of the connecting element 5 and use the upper horizontal portion of the connecting element 6 as a table, while the belt 10 holds the child in the sitting position. In FIGS. 1–4, the toy is in a standing position, by standing on a surface with the legs. In the same standing position two children can sit in the toy, so that one child sits on the upper horizontal portion of one connecting element 5 and holds the legs on the lower horizontal portion of the same connecting element, while another child sits on the upper horizontal portion of the upper connecting element 6 and holds his legs on the lower horizontal portion of this connecting element.

Figure 6:
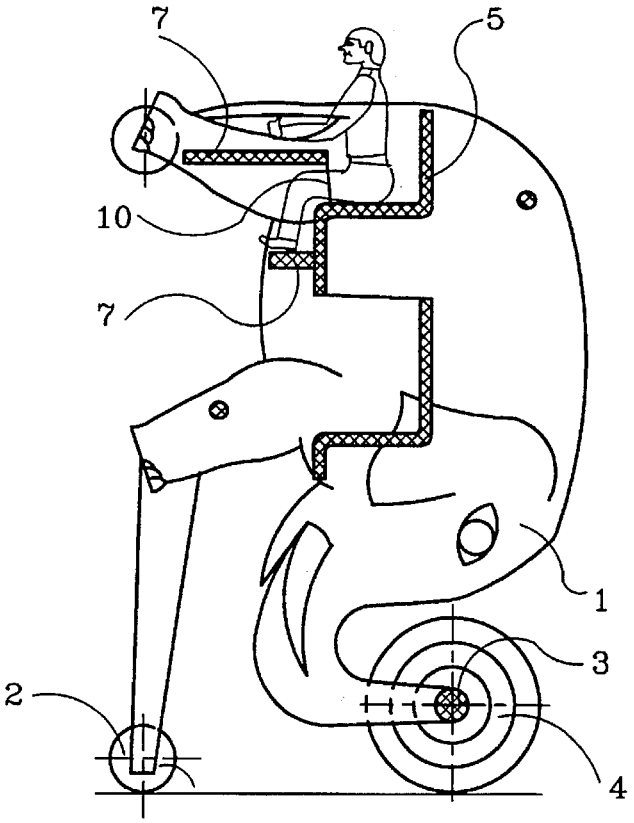
FIG. 6 is a view showing the inventive toy in a position turned by 90° relative to the standing position.

In FIG. 6 the toy is turned by 90° so that it is supported on the wheels 2 and the discs 4. In this position a child can sit on the formerly vertical portion of the connecting element 5 which is now the horizontal portion and use the portion 7 as a table, being held again by the belt 10.

Figure 7:
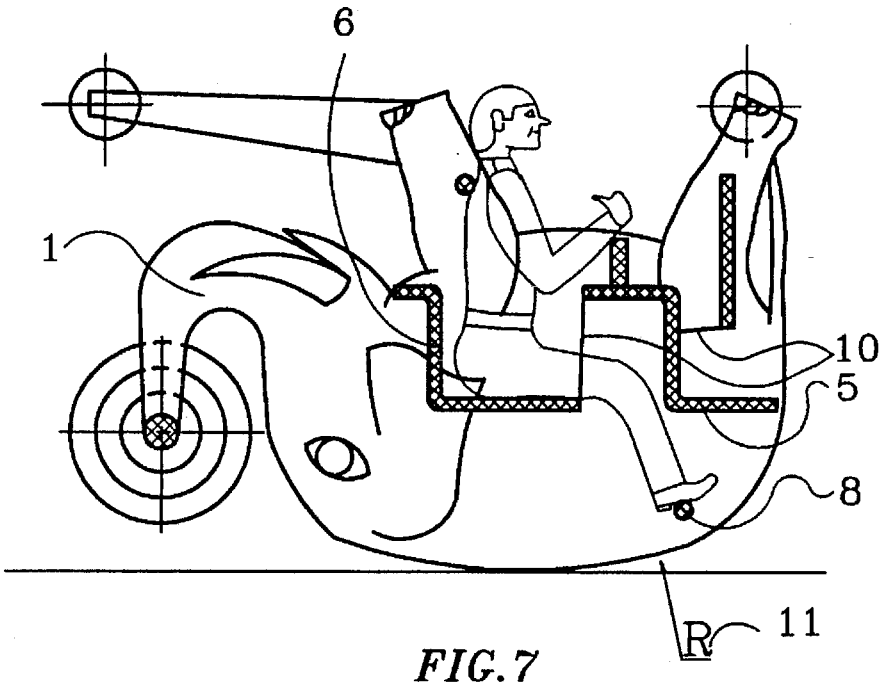
FIG. 7 is a view showing the toy which is turned upside down by 180° from the standing position.

In the position of FIG. 7, the toy is turned upside down by 90° so that the backs of the elephants which are curved are supported on a surface and therefore the toy can rock. Here, a child can sit on a formerly upper portion of the connecting element 6 which is now the lower portion and use the formerly lower portion of the connecting element 5 which is now the upper portion as a table, being held by the belt. His legs can rest on the rod 8.

Figure 8:
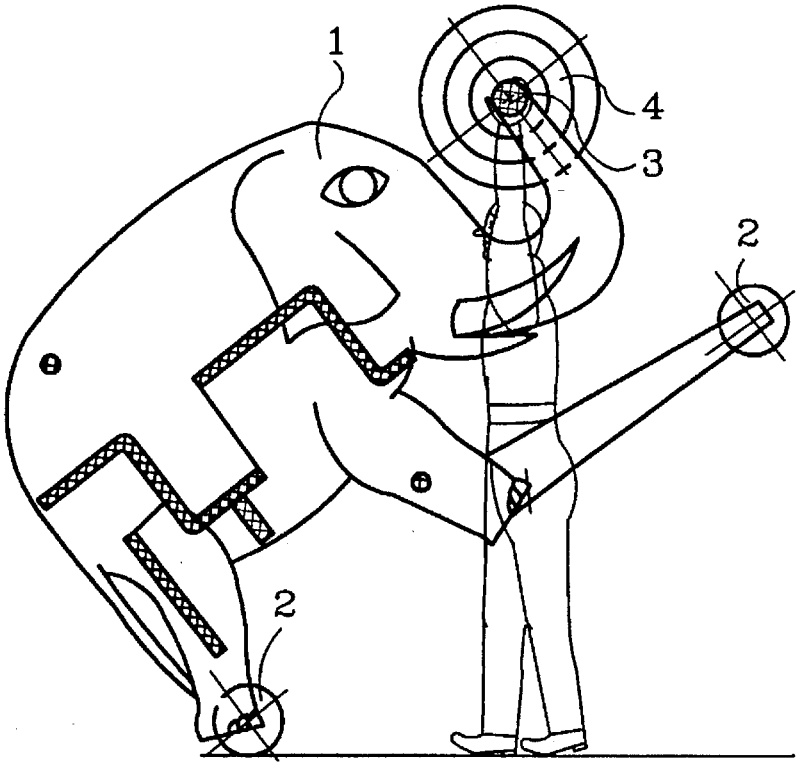
FIG. 8 is a view showing the inventive toy with a user exercising with the toy by lifting the same.

As shown in FIG. 8, a child can use the rod 3 so as to lift the toy and therefore to exercise in lifting weights. Discs 4 having different weights can be installed on the rod 3 so as to adjust the weight liftable by the child.

Figure 9:
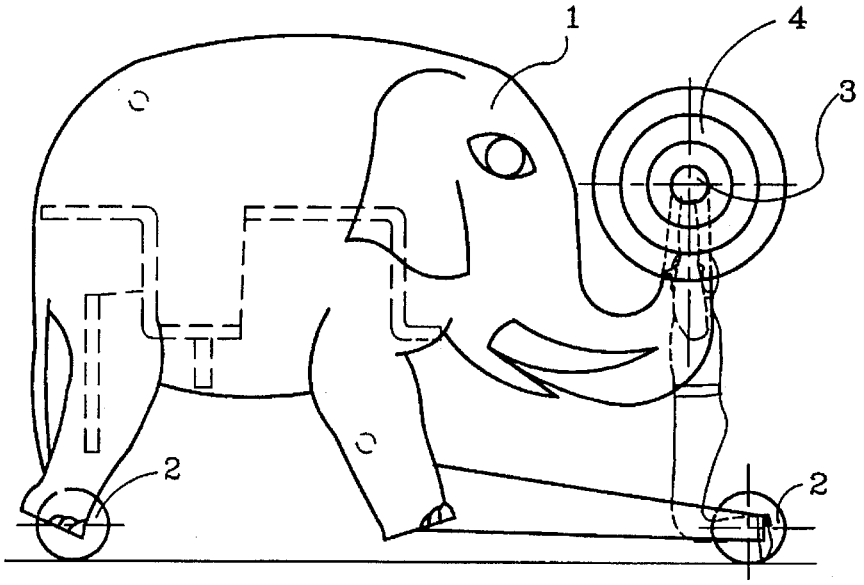
FIG. 9 is a view substantially corresponding to the view of FIG. 8 but showing a user doing another exercise with the inventive toy.

As shown in FIG. 9 a child can suspend himself on the rod 3 so as to exercise in lifting and lowering himself on the rod 3 so as to exercise his muscles.

Figure 10:
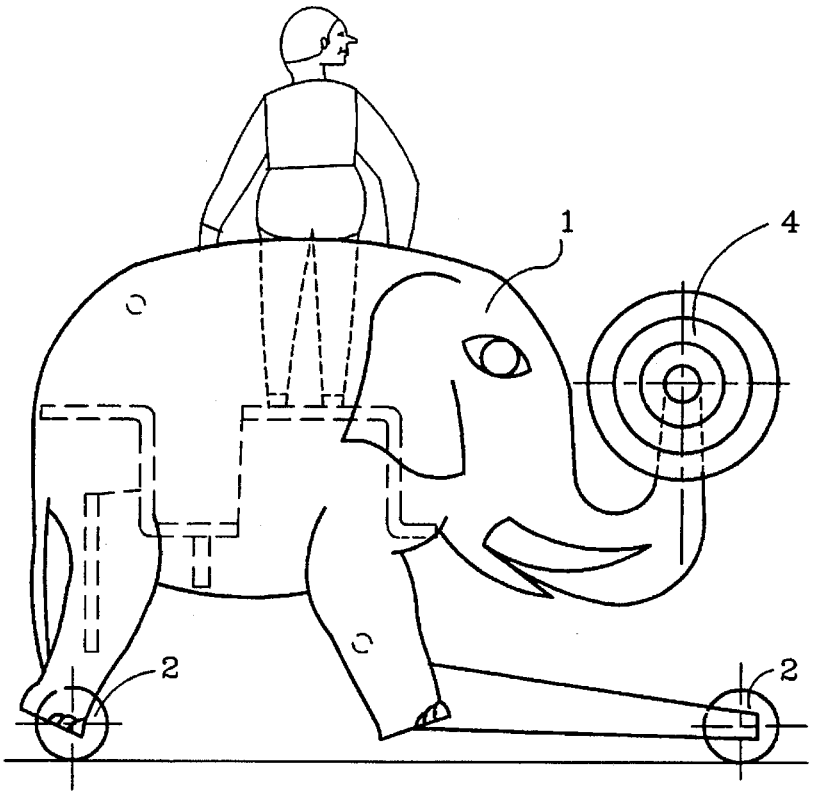
FIG. 10 is a view showing the inventive toy with the user standing in the toy and doing still another exercise.

Finally, in FIG. 10 a child can stand on the horizontal portions of the connecting elements 5 and 6 and to support himself on the backs of the animals, or move from the left to the right inside the animal, or slide on the elephant backs, etc.

Thus, the toy in accordance with the present invention provides for a plurality possibilities for the child to play with the toy in a way which was not possible before.

The toy of the invention can have a much smaller size, in which case it can be used for placing dolls into it instead of children.

It will be understood that each of the elements described above, or two or more together, may also find a useful application in other types of constructions differing from the types described above.

While the invention has been illustrated and described as embodied in a toy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A toy, comprising a body part formed by two animal body elements spaced from one another in a transverse direction, each of said body elements having two legs extending downwardly and engaging a ground surface in a first position of the toy and a curved back extending in the first position of the toy upwardly beyond all remaining parts of the toy, each of said body elements also having a nose portion projecting horizontally forwardly in the first position of the toy; and means for connecting said body elements with one another and including two Z-shaped connecting elements each consisting of two horizontal portions which are offset relative to one another in a horizontal direction and in a vertical direction and a vertical portion connecting proximal ends of said horizontal portions with one another, so that in the first position of the toy a user sits on one horizontal portion and places his legs on another horizontal portion of a first one of said connecting elements, while in a second position wherein the toy is turned upside down said curved back engages the ground surface and a user sits on said horizontal portion of a second one of said connecting elements and rocks on said curved back of said body elements, and in a third position wherein the toy is turned 90° and said nose portion engages the ground surface, the user sits on said vertical portion of said first connecting element.

2. A toy as defined in claim 1, wherein one of said legs of each of said body elements has a projection, so that when the toy is in said third position said projections and said nose portion engages the ground surface.

3. A toy as defined in claim 1, wherein said nose portions of said body elements are connected with one another by a rod so that in said first position of the toy the user can lift the toy by grasping said rod and applying an upward force.

4. A toy as defined in claim 3; and further comprising a plurality of weights removably attachable to said rod.

5. A toy as defined in claim 1; and further comprising wheel means attached to said body elements so that the toy can roll on wheels.

6. A toy as defined in claim 1, wherein said body elements have each a shape of an elephant so that each of said body elements has an elephant body, two elephant legs formed by said legs, and an elephant head provided with a trunk formed by said nose portion.

7. A toy, comprising a body part formed by two animal body elements spaced from one another in a transverse direction, each of said body elements having two legs extending downwardly and engaging a ground surface in a first position of the toy and a curved back extending in the first position of the toy upwardly beyond all remaining parts of the toy, each of said body elements also having a nose portion projecting horizontally forwardly in the first position of the toy; and means for connecting said body elements with one another and including two Z-shaped connecting elements each consisting of two horizontal portions which are offset relative to one another in a horizontal direction and in a vertical direction and a vertical portion connecting proximal ends of said horizontal portions with one another, so that in the first position of the toy a user sits on one horizontal portion and place his legs on another horizontal portion of a first one of said connecting elements, while in a second position wherein the toy is turned upside down said curved back engages the ground surface and a user sits on said horizontal portion of a second one of said connecting elements and rocks on said curved back of said body elements, and in a third position wherein the toy is turned 90° and said nose portion engages the ground surface, the user sits on said vertical portion of said first connecting element; and an additional vertical connecting portion which connects said body elements with one another arranged so that in said third position said additional vertical connecting portion is arranged horizontally and forms a table for the user.

* * * * *